US010144886B2

(12) United States Patent
Martin

(10) Patent No.: US 10,144,886 B2
(45) Date of Patent: Dec. 4, 2018

(54) CHURNING AND STOKING RAM

(71) Applicant: Entech—Renewable Energy Solutions Pty Ltd, Canning Vale, Western Australia (AU)

(72) Inventor: Neil Martin, Welshpool (AU)

(73) Assignee: ENTECH—RENEWABLE ENERGY SOLUTIONS PTY LTD., Canning Vale, Western Australia (AU)

( * ) Notice: Subject to any disclaimer, the term of this patent is extended or adjusted under 35 U.S.C. 154(b) by 233 days.

(21) Appl. No.: 14/915,023

(22) PCT Filed: Aug. 26, 2014

(86) PCT No.: PCT/AU2014/000842
§ 371 (c)(1),
(2) Date: Feb. 26, 2016

(87) PCT Pub. No.: WO2015/027273
PCT Pub. Date: Mar. 5, 2015

(65) Prior Publication Data

US 2016/0208181 A1 Jul. 21, 2016

(30) Foreign Application Priority Data

Aug. 27, 2013 (AU) ..... 2013903261

(51) Int. Cl.
*C10J 3/32* (2006.01)
*C10J 3/00* (2006.01)
(Continued)

(52) U.S. Cl.
CPC ..... *C10J 3/32* (2013.01); *C10B 37/00* (2013.01); *C10B 53/00* (2013.01); *C10B 53/07* (2013.01);
(Continued)

(58) Field of Classification Search
CPC ..... C10J 3/00; C10J 3/32; C10J 3/721; C10J 2300/0946; C10B 37/00; C10B 53/00;
(Continued)

(56) References Cited

U.S. PATENT DOCUMENTS 1,521,231 A 12/1924 Daae
3,939,297 A 2/1976 Aylard et al.
(Continued)

FOREIGN PATENT DOCUMENTS

DE 2731549 A1 2/1978
FR 2566099 * 12/1985 ..... F23G 5/16
(Continued)

OTHER PUBLICATIONS

JPH11182826A_ENG (Espacenet machine translation of Yamagata) (Year: 1999).*
(Continued)

*Primary Examiner* — Renee Robinson
*Assistant Examiner* — Gabriel E Gitman

(57) ABSTRACT

A churning and stoking ram for a furnace is disclosed. The churning and stoking ram includes a frame disposed externally of the furnace, where the stoking ram is mounted on the frame. The stoking ram is positionable relative to the furnace between an external position and an internal position, and is rotatable about a central longitudinal axis of the stoking ram. The stoking ram further includes a churning device positionable relative to the stoking ram between a retracted position and an extended position, a first actuator mounted on the frame to position the stoking ram between the external and internal positions, a second actuator to position the churning device between the retracted and extended positions, and a third actuator to rotate the stoking ram and the churning device associated therewith.

20 Claims, 5 Drawing Sheets

(51) Int. Cl.

| | |
|---|---|
| ***F27D 3/04*** | (2006.01) |
| ***C10B 53/00*** | (2006.01) |
| ***C10B 37/00*** | (2006.01) |
| ***C10B 53/07*** | (2006.01) |
| ***C10J 3/72*** | (2006.01) |

(52) U.S. Cl.
CPC ..... *C10J 3/00* (2013.01); *C10J 3/721* (2013.01); *F27D 3/04* (2013.01); *C10J 2300/0946* (2013.01); *F23G 2201/40* (2013.01); *F23G 2203/803* (2013.01); *F23G 2205/10* (2013.01)

(58) Field of Classification Search
CPC ..... C10B 53/07; F27D 3/04; F23G 2201/40; F23G 2203/803; F23G 2205/10
See application file for complete search history.

(56) References Cited

U.S. PATENT DOCUMENTS

| | | | | | |
|---|---|---|---|---|---|
| 4,074,638 | A * | 2/1978 | Miller | F23G 5/027 110/109 | |
| 4,217,175 | A | 8/1980 | Reilly | | |
| 4,259,910 | A * | 4/1981 | Warren | F23G 5/16 110/211 | |
| 2002/0021736 | A1 * | 2/2002 | Takizawa | B22D 17/30 373/85 | |
| 2012/0292835 | A1 | 11/2012 | Sato | | |

FOREIGN PATENT DOCUMENTS

| | | | | |
|---|---|---|---|---|
| GB | 191300074 | A * | 12/1913 | F23K 3/00 |
| GB | 191300074 | A | 12/1913 | |
| GB | 2453111 | A | 4/2009 | |
| JP | H11182826 | A * | 7/1999 | F23G 5/00 |
| JP | H-11182826 | A | 7/1999 | |

OTHER PUBLICATIONS

FR2566099_ENG (Espacenet machine translation of Gobron) (Year: 1985).*
International Preliminary Report on Patentability, dated Jul. 31, 2015, PCT/AU2014/000842, 6 pages, IPEA/AU.
International Search Report, dated Oct. 29, 2014, PCT/AU2014/000842, 4 pages, ISA/AU.
Written Opinion of the International Searching Authority, dated Oct. 29, 2014, PCT/AU2014/000842, 5 pages, ISA/AU.
European Patent Office, European Application 14840723.2, Supplementary European Search Report, dated Aug. 3, 2017, 8 pages, Europe.
Office Action issued for Chinese Patent Application No. 201480055725.9 dated Apr. 24, 2017.

* cited by examiner

CHURNING AND STOKING RAM

PRIORITY

The present application is a U.S. National Stage patent application of International Application No. PCT/AU2014/000842, filed on Aug. 26, 2014, which claims priority to Australian Patent Application No. 2013903261, entitled, "CHURNING AND STOKING RAM," filed Aug. 27, 2013, also naming Neil Martin as inventor, the disclosures of which are hereby incorporated by reference in their entirety.

FIELD OF THE DISCLOSURE

The present disclosure relates to a churning and stoking ram, in particular to a churning and stoking ram for use in furnaces. The disclosure also relates to a furnace capable of mechanically agitating the contents thereof and a system for low temperature gasification of waste solids. Additionally, the disclosure relates to a method of mechanically agitating the contents of a furnace.

BACKGROUND

Gasification of carbonaceous materials typically involves a thermal reaction between the carbonaceous material, oxygen and steam to create a mixture of low weight hydrocarbons, such as methane, carbon monoxide and hydrogen (syngas). Gasification is widely used to produce syngas for firing or syngas for refining into chemicals, liquid fuels and hydrogen, and has been identified as a key enabling technology for advanced high-efficiency, low-emission non-fossil fuel and renewable energy power generation.

High temperature gasification and other medium to light combustion air input thermal processes generate turbulent hot gases. In turn, the turbulent hot gases facilitate pneumatic agitation of the contents of a furnace, thus assisting in consumption of the carbonaceous material as "fresh" surfaces are brought into contact with the process reactants.

Pneumatic agitation, however, can result in entrainment of solids, heavy metals and ash in the resulting syngas product stream, which is then treated by downstream filtration techniques and/or scrubbing to remove the entrained solids and ash.

The application of high temperature gasification and other medium to high combustion air input thermal processes to manage municipal waste presents many difficulties, particularly because of the lack of homogeneity of the contents in terms of size and composition compared to other carbonaceous materials such as coal and blomass.

The average moisture content of municipal waste may vary from 20-60%, or higher, and the average incombustible content may vary from 5-30% or higher, with some waste charges having 100% incombustible items (e.g., glass, metals, etc.). A high incombustible content results in a high density charge with concomitant increased accumulation of incombustibles/ash content The larger percentage of inorganic solids and ash that is not consumed by combustion processes leads to an increase in the downstream clean-up processes required to provide a syngas product stream and reduced production efficiency.

Further, the high incombustible or ash content accumulates in the gasification or combustion chamber and depletes the available space in the gasification or combustion chamber. After 6-8 hours of operation under typical conditions, several issues can occur if the volume occupied by incombustible material and ash is not reduced by ejection, including:

1) loss of control of process conditions (e.g., temperature, throughput velocities, etc.);
2) increased process gas velocity/turbulence leading to increased particulate entrainment in the syngas product stream;
3) incoming raw waste compacts the incompletely gasified or combusted material and ash in the combustion chamber, causing further reduced thermal efficiency; and
4) compaction of raw waste leads to obstructions in the feed stream.

Furthermore, complete gasification or combustion of the contents is not always achievable as pneumatic agitation may not prove sufficiently strong to bring larger, heavier particles in the waste solids in contact with the combustion reactants. Waste that has a high moisture content, incombustible content and density can self insulate from the gasification or combustion process and form sections or "pockets" of coagulated or partially degraded waste that substantially reduces thermal efficiency, in addition to partially degraded matter being ejected with ash.

In contrast, low temperature gasification relies on thermal degradation of the carbonaceous material in an oxygen-depleted ultra-low sub-stoichiometric environment, rather than combustion reactions, to produce a syngas product stream.

The application of low temperature gasification in the management of heterogeneous mixtures of municipal waste minimizes the problem of entrained solids and ash in the syngas product stream because there is little or no pneumatic agitation of the contents of the furnace in which low temperature gasification occurs. Conversely, however, in the absence of pneumatic agitation, there is little mixing of the waste solids within the furnace, resulting in the stratification of the contents where thermally degraded material overlies unreacted carbonaceous material. Where inorganic material, particularly silica-containing material, thermally degrades to form a slag, a mechanical barrier to further thermal degradation of the underlying contents may form, and many of the problems listed above may also arise.

SUMMARY OF THE DISCLOSURE

In its broadest aspect, the disclosure provides a churning and stoking ram for a furnace capable of mechanically agitating the contents therein, and a system for low temperature gasification of waste solids. The disclosure also provides a method of mechanically agitating the contents of a furnace.

Accordingly, in a first aspect of the disclosure, there is provided a churning and stoking ram for a furnace comprising:

- a frame disposed externally of the furnace;
- a stoking ram supported on the frame in an arrangement to enable the stoking ram to be positionable relative to the furnace between an external position and an internal position and to be rotatable about a central longitudinal axis of the stoking ram;
- a first actuator mounted on the frame in operative communication with the stoking ram in an arrangement to position the stoking ram between the external and internal positions;

a churning device associated with the stoking ram and positionable relative to the stoking ram between a retracted position and an extended position;

a second actuator in operative communication with the churning device in an arrangement to position the churning device between the retracted and extended positions; and a third actuator in operative communication with the stoking ram in an arrangement to rotate the stoking ram and the churning device associated therewith.

In one embodiment of the disclosure, the churning device and the second actuator are housed in an internal void of the stoking ram. The second actuator is operative to impart translational movement of the churning device along the central longitudinal axis of the stoking ram between the retracted position wherein the churning device is disposed in the internal void of the stoking ram, and the extended position wherein the churning device is disposed externally of the stoking ram in longitudinal alignment therewith.

In one embodiment, the churning device comprises an elongate member having a plurality of paddles outwardly depending therefrom.

In another embodiment, the paddles are equiangularly disposed around a central longitudinal axis of the elongate member. In a preferred embodiment, the paddles extend continuously along a length of the elongate member. In an alternative embodiment, the paddles are configured in discontinuous spiral flutes along the length of the elongate member.

In a further embodiment, the stoking ram is provided with a removable head.

In one embodiment, the churning device and/or the stoking ram are generally horizontally disposed proximal a lower surface of the furnace when the churning device is extended and/or the stoking ram is in the internal position relative to the furnace.

In accordance with a second aspect of the disclosure, there is provided an apparatus capable of mechanically agitating the contents therein, the apparatus comprising a furnace provided with the churning and stoking ram as described above.

In a preferred embodiment of the disclosure, the apparatus is provided with a pair of churning and stoking rams in spaced parallel alignment with one another. The pair of churning and stoking rams may be arranged to operate independently of one another, or in an inter-related sequence of operations determined by the positions of the stoking ram and the churning device of each respective churning and stoking ram.

In accordance with a third aspect of the disclosure, there is provided a system for low temperature gasification of waste solids comprising one or a plurality of furnaces adapted for low temperature gasification of waste solids, adjacent furnaces being disposed in stepped tiers, each furnace being provided with a churning and stoking ram as described above to mechanically agitate the waste solids therein.

In a preferred embodiment of the disclosure, each furnace is provided with a pair of churning and stoking rams in spaced parallel alignment with one another. The pair of churning and stoking rams may be arranged to operate independently of one another, or in an inter-related sequence of operations determined by the positions of the stoking ram and the churning device of each respective churning and stoking ram.

In accordance with a fourth aspect of the disclosure, there is provided a method of pyrolyising solid municipal waste comprising:

heating the solid municipal waste in a furnace operating at temperatures in a range of 500° C. to 1100° C.;

inserting a churning device into the furnace; and, rotating the churning device about its longitudinal axis to mechanically agitate the solid municipal waste to expose and thermally degrade partially pyrolysed solid municipal waste.

The method may further comprise discharging the partially pyrolysed solid municipal waste into an adjacent furnace for further pyrolysis.

In one embodiment of the disclosure the churning device is generally horizontally disposed proximal a lower surface of the furnace when the churning device is inserted into the furnace.

BRIEF DESCRIPTION OF THE DRAWINGS

The preferred embodiments of the present disclosure will now be described, by way of example only, with reference to the accompanying drawings, in which.

DETAILED DESCRIPTION

Figure 1:
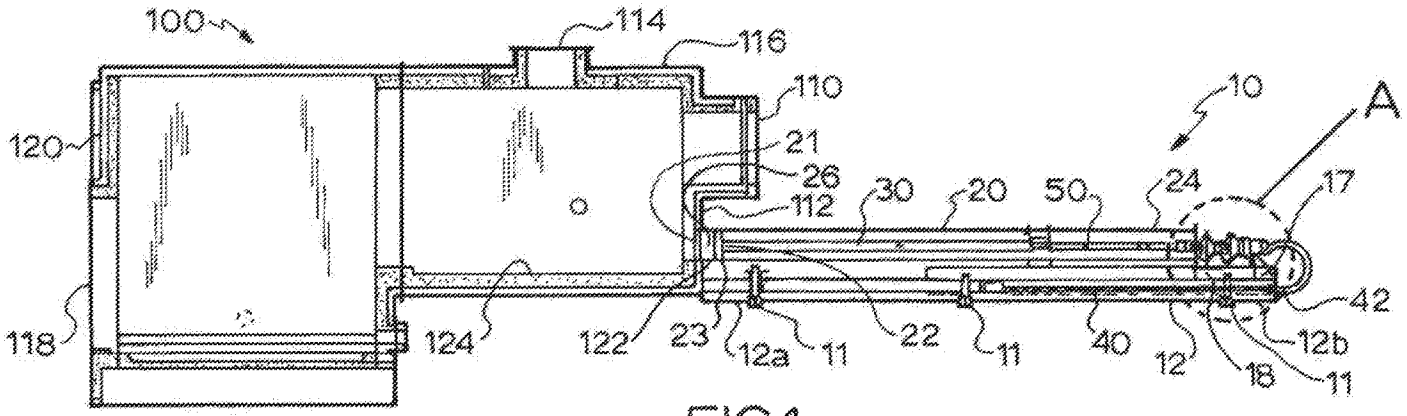
FIG. 1 shows a side view of the churning and stoking ram in accordance with the present disclosure with a stoking ram and churning device thereof in the external position and retracted position, respectively.

Referring to the figures, where like numerals refers to like parts throughout, there is shown a furnace 100 provided with one or more churning and stoking rams 10. In a preferred embodiment of the disclosure, the furnace 100 is a static or fixed hearth, in particular a static or fixed hearth in a low temperature gasification chamber adapted for semi-pyrolysis of municipal solid waste. Typically, the low temperature gasification chamber operates at temperatures in a range of about 500° C. to about 1100° C., in particular in a temperature range of about 700° C. to about 850° C. It will be appreciated, however, that in other embodiments, the furnace 100 may be a high temperature gasifier, an incinerator or a fluidized bed operating in a higher temperature range, such as for example in a temperature range where combustion reactions proceed. The furnace 100 may be directly or indirectly heated, and is of generally conventional design.

In the embodiment shown in FIGS. 1 to 6, the furnace 100 is provided with a first input port 110 in a side wall 112 of the furnace 100 for receiving feed material into the furnace 100, and an output port 114 in an upper wall 116 of the furnace for discharging gases evolved during thermal degradation of the feed material by combustion, high temperature gasification or low temperature pyrolysis reactions. The furnace 100 is also provided with a discharge port 118 for discharging solid residues and ash resulting from the thermal degradation processes occurring within the furnace 100. The discharge port 118 may be located in a lower wall (not shown) or an opposing side wall 120 of the furnace. It will be appreciated that the furnace 100 as illustrated may be one of a plurality of stepped furnaces in a lower temperature gasification chamber wherein the discharge port 118 is configured to direct partially degraded feed material from a first stepped furnace 100' to an adjacent second stepped furnace 100' for further thermal degradation, and so forth.

Typically, the solid residues and ash are discharged from the furnace 100 via the discharge port 118, or alternatively, from the first stepped furnace 100' to an adjacent second stepped furnace 100' via the discharge port 118 as a result of a stoking action imparted by the churning and stoking ram 10 of the present disclosure. Accordingly, the furnace 100 is also provided with one or more second input ports 122 in the side wall 112 of the furnace for receiving respective churning and stoking rams 10 into the furnace 100. Typically, the one or more second input ports 122 are located below the first input port 110 and spaced apart from a lower surface 124 of the furnace 100 on which the furnace contents will be thermally degraded.

The churning and stoking ram 10 includes a frame 12 disposed externally of the furnace 100, a stoking ram 20 mounted on the frame 12, and a churning device 30 associated with the stoking ram 20.

The frame 12 is disposed in general horizontal parallel alignment with the lower surface 124 of the furnace 100, and has a proximal end 12*a* which abuts the side wall 112 of the furnace 100 and a distal end 12*b* with respect to the side wall 112 of the furnace 100, so that the stoking ram 20 is longitudinally aligned with the second input port 122 of the furnace 100.

Figure 9:
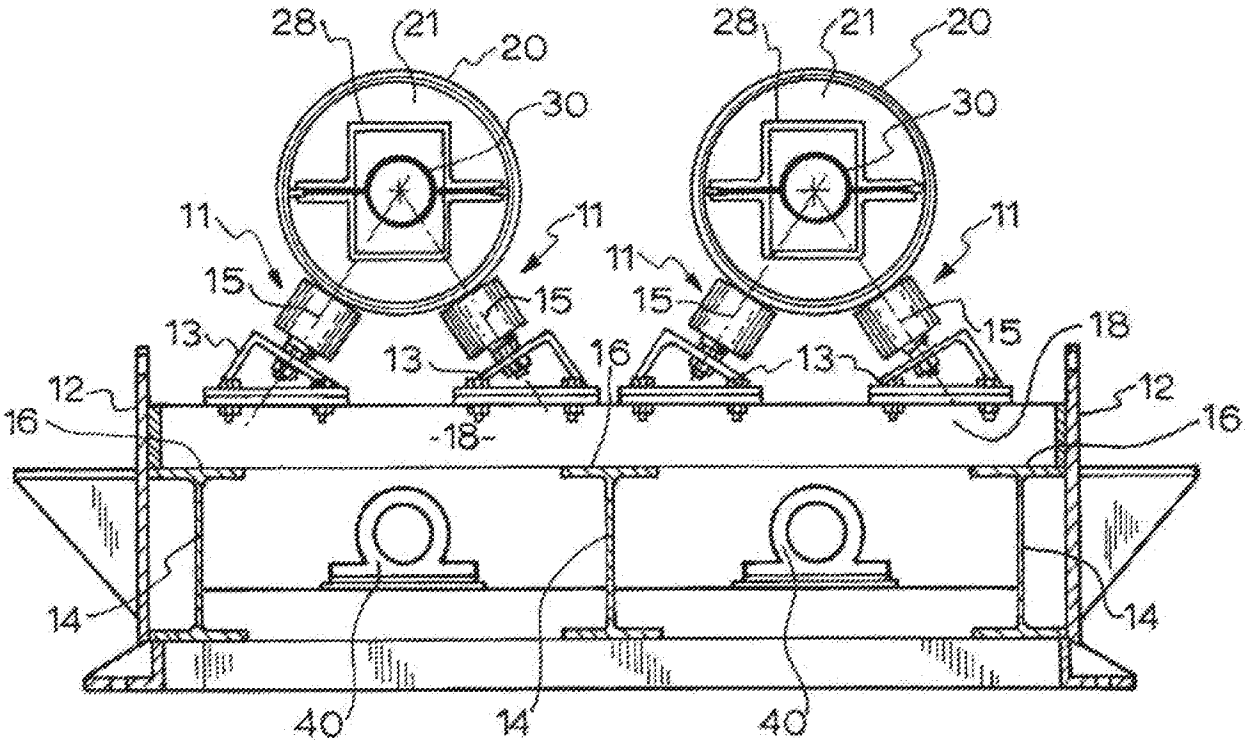

The frame 12 in this particular embodiment includes a pair of spaced-apart parallel I-beams 14 shown in more detail in FIG. 9. Respective upper sections 16 thereof support an elongate plate 18 in an arrangement which enables the elongate plate 18 to be positioned relative to the upper sections 16 along a length thereof. In the embodiment shown in the figures, said arrangement involves a coupling plate 17 that is fixed to a distal end 19 of the elongate plate 18 and to a distal end 42 of a first actuator 40. When the first actuator 40 is in a fully extended position the elongate plate 18 is caused to be located at the distal end 12*b* of the frame 12, and conversely when the first actuator 40 is in a fully retracted position, the elongate plate 18 is caused to be located at the point intermediate the proximal and distal ends 12*a*, 12*b* of the frame 12.

In one embodiment of the disclosure, the first actuator 40 is a hydraulic ram. Illustrative examples of a hydraulic ram include a single stroke hydraulic ram or a telescopic hydraulic ram. By locating the hydraulic ram within the frame 12, a full stroke movement between the fully extended position and the fully retracted position is possible along the length of the frame 12.

In another embodiment, the first actuator 40 need not be a hydraulic ram but can be a ratchet wheel that interacts with a pawl to move the associated stoking ram 20 in a sliding manner by manual movement between various fixed positions, for example by being moved along a perforated slide rail. In that sense, the translation of the stoking ram 20 can also mean a non-continuous, incremental transitory motion, unlike the continuous translation offered by a piston or hydraulic ram. Other types of actuators are also within the scope of the disclosure, such as geared electric motors or even threaded rods.

The upper sections 16 of the frame 12 are also provided with one or more fixed roller assemblies 11 as shown in detail in FIG. 9. The roller assemblies 11 are regularly spaced along the length of the frame 12 and are configured to support the stoking ram 20 and to facilitate translation of the stoking ram 20 relative to the frame 12 and rotation of the stoking ram 20 about a central longitudinal axis thereof. Preferably, one roller assembly 11 is disposed proximal the side wall 112 of the furnace 100 to support a free end 22 of the stoking ram 20.

The roller assembly 11 comprises a pair of spaced apart brackets 13 fixed to the upper sections 16 of the frame 12 and respective rollers 15 rotatably mounted on each bracket 13. The brackets 13 are spaced apart at a distance to enable the stoking ram 20 to be contiguously disposed on circumferential surfaces of the rollers 15.

In a preferred embodiment of the disclosure, the frame 12 comprises three spaced apart parallel I-beams 14, as shown in FIG. 9, capable of supporting thereon a pair of parallel elongate plates 18 which can be positioned independently of one another along a length of the frame 12, with respective pairs of spaced apart roller assemblies 11. In this way, it will be appreciated that a pair of independently translatable stoking rams 20 can be mounted on the frame 12.

Figure 2:
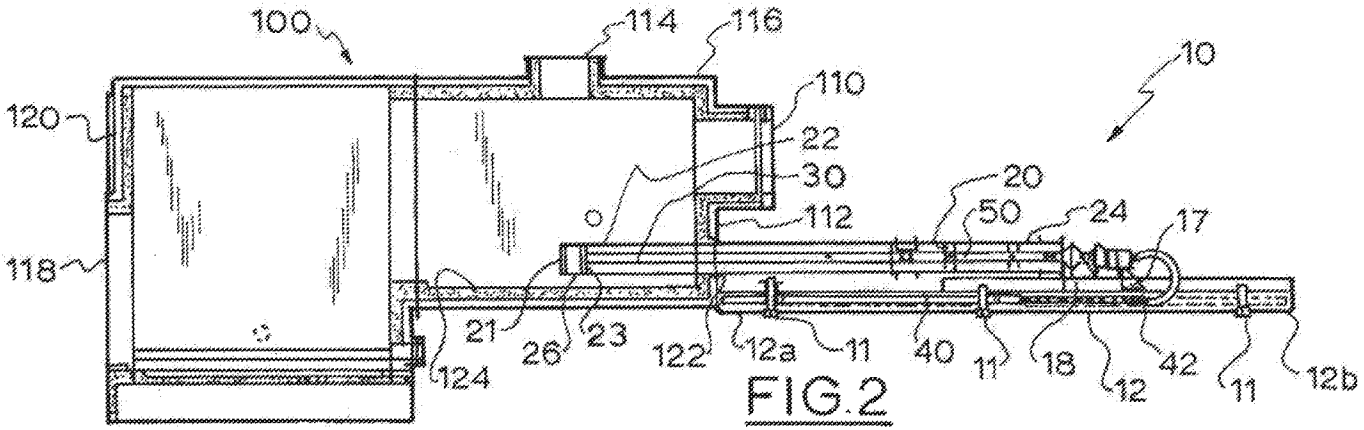
FIG. 2 shows a side view of the churning and stoking ram of FIG. 1 with the stoking ram positioned halfway between the external and the internal position.
Figure 3:
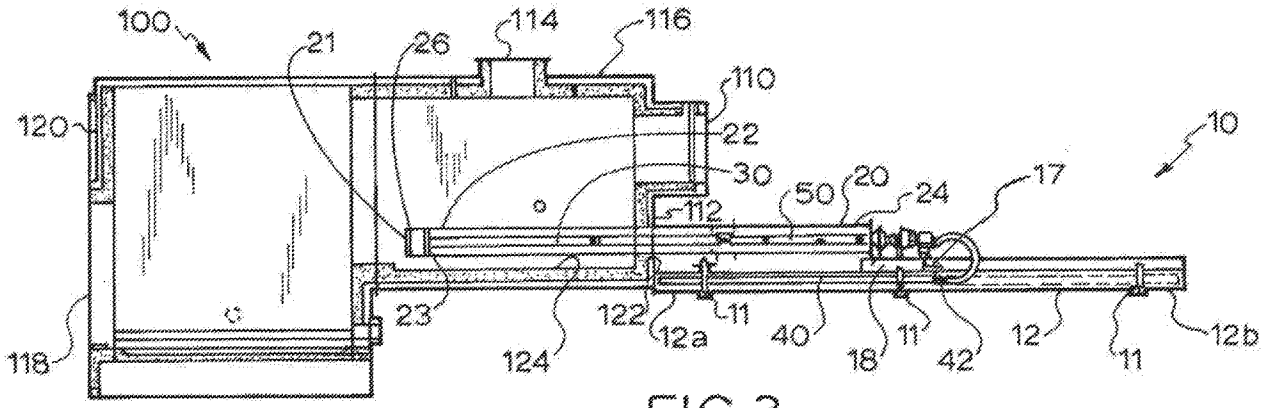
FIG. 3 shows a side view of the churning and stoking ram of FIGS. 1 and 2 with the stoking ram in the internal position.

The stoking ram 20 is supported on the frame 12 by the roller assemblies 11 in an arrangement to enable the stoking ram 20 to be positionable relative to the furnace 100 between an external position as shown in FIG. 1, an internal position as shown in FIG. 3, and a position intermediate of the external and internal positions as, for example, shown in FIG. 2. The advantage of positioning the stoking ram 20 in the external position, when the churning and stoking ram 10 is not in use and when a stoking action on the contents of the furnace 100 is not required, is that the churning and stoking ram 10 is not continuously exposed to ambient furnace temperatures and therefore not subject to conditions under which it will unduly wear.

Positioning of the free end 22 of the stoking ram 20 between the external and internal positions with respect to the furnace 100 is effected by the first actuator 40 which is in operative communication with a fixed end 24 of the stoking ram 20, as will be described later. When the first actuator 40 is in a fully extended position, the stoking ram 20 is located in the external position; and conversely, when the first actuator 40 is in a fully retracted position, the stoking ram 20 is located in the internal position.

In one embodiment of the disclosure, the stoking ram 20 is a hollow elongate section, preferably a cylindrical tube, with the free end 22 and the fixed closed end 24. As the free end 22 is subject to most wear throughout the operational life of the stoking ram 20, it is preferable that the free end 22 is provided with a removable head 26. The materials of construction of the removable head 26 of the stoking ram 20 can be any suitable materials that wear appropriately under ambient furnace temperatures of about 500° C. to about 1100° C., and that can be shaped, formed and fitted in the manner so described, and may include ceramics, and appropriate heat and wear resistant metals and metal alloys, and so on.

Figure 4:
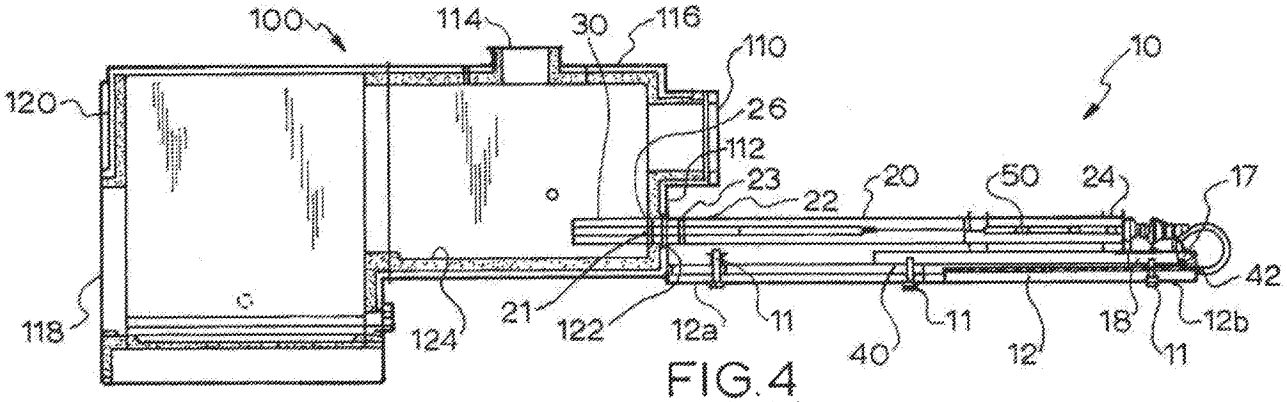
FIG. 4 shows a side view of the churning and stoking ram of FIGS. 1-3 with the stoking ram and churning device thereof in the external position and extended position, respectively.
Figure 5:
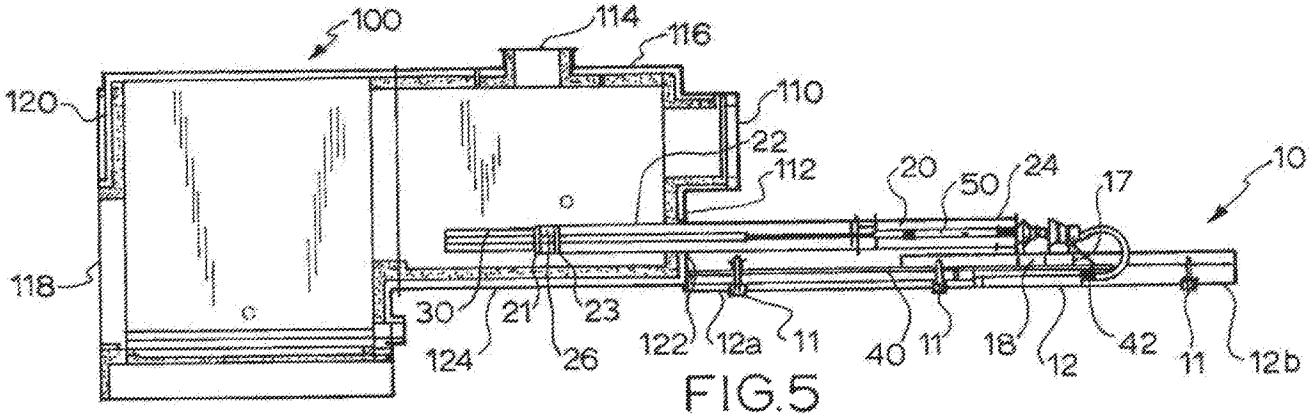
FIG. 5 shows a side view of the churning and stoking ram of FIGS. 1-4 with the stoking ram positioned halfway between the external position and the internal position, and the churning device in the extended position.
Figure 6:
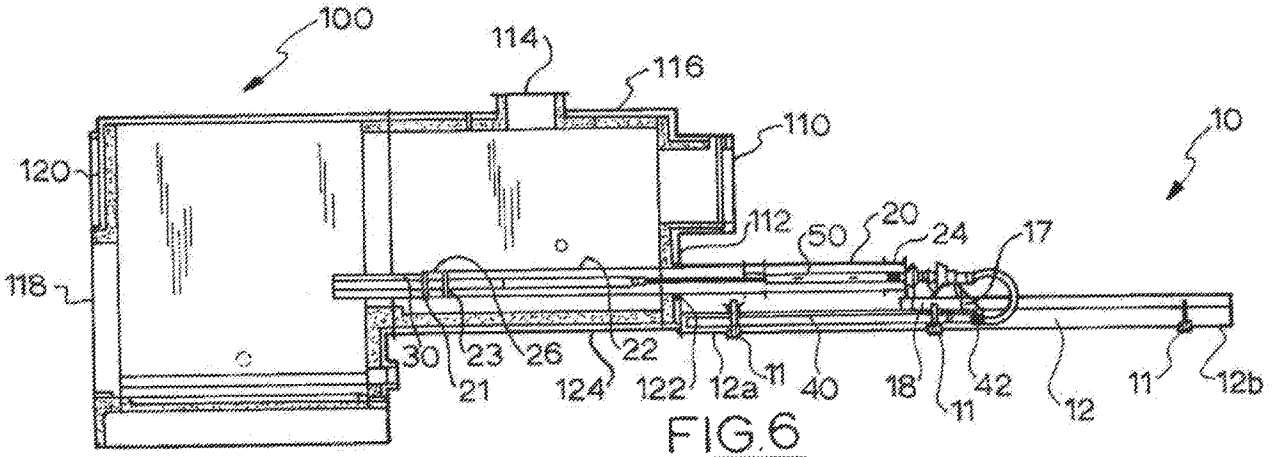
FIG. 6 shows a side view of the churning and stoking ram of FIGS. 1-4 with the stoking ram and churning device thereof in the internal position and the extended position, respectively.

The churning device 30 associated with the stoking ram 20 is positionable relative to the stoking ram 20 between a retracted position as shown in FIGS. 1, 2, and 3 and an extended position as shown in FIGS. 4, 5 and 6. A second actuator 50 is in operative communication with the churning device 30 in an arrangement to position the churning device 30 between the retracted and extended positions.

In one embodiment of the disclosure, the churning device 30 and the second actuator 50 are housed in an internal void of the stoking ram 20 in longitudinal alignment with one another. The second actuator 50 is disposed adjacent the distal end 24 of the stoking ram 20 and the churning device 30 is disposed adjacent the leading end 22 of the stoking ram 20. The second actuator 50 is operative to impart translational movement to the churning device 30 along a longitudinal axis of the stoking ram 20 between the retracted position wherein the churning device 30 is disposed in the internal void 28 of the stoking ram 20, and the extended position wherein the churning device 30 is disposed externally of the stoking ram 20 in longitudinal alignment therewith.

It will be appreciated that the removable head 26 of the stoking ram 20 is provided with void 28 (FIG. 7) extending between its leading and rear faces 21, 23, the void 28 being shaped and sized to allow the passage of the churning device 30 therethrough when the churning device 30 is positioned in the extended position, as shown in FIGS. 4 to 7.

In one embodiment of the disclosure, the second actuator 50 is a hydraulic ram. Illustrative examples of a hydraulic ram include a single stroke hydraulic ram or a telescopic hydraulic ram movable between a fully extended and a fully retracted configuration, respectively. When the hydraulic ram is fully extended, it translates the churning device 30 to the extended position and, conversely, when the hydraulic ram is fully retracted it translates the churning device 30 to the retracted position. Other types of actuators are also within the scope of the disclosure, such as geared electric motors or even threaded rods.

Figure 7:
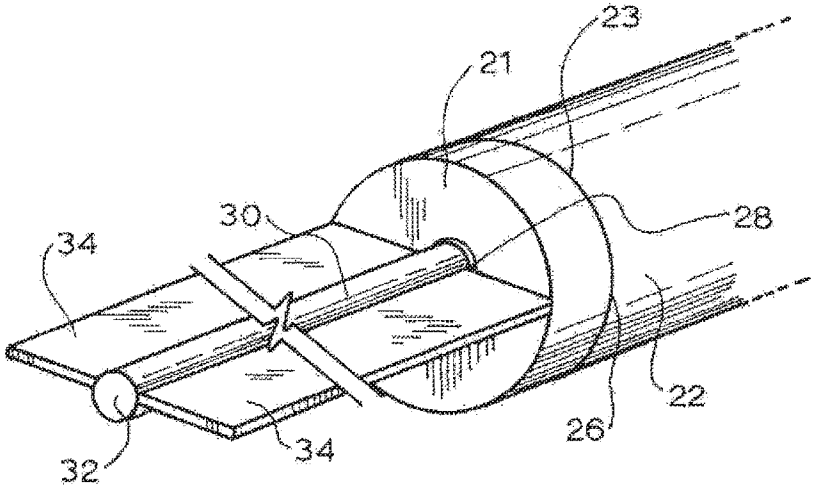
FIG. 7 shows a partial perspective view of one embodiment of the churning device.

Referring to FIG. 7, the churning device 30 comprises an elongate member 32 having a plurality of paddles 34 outwardly depending therefrom. The elongate member 32 may have a circular or a square cross section.

The paddles 34 are equiangularly disposed around a central longitudinal axis of the elongate member 32. In FIG. 7, the churning device 30 is shown with two diametrically opposed paddles 34. However, it will be appreciated that the churning device 30 could be provided with three paddles spaced at 120° from one another, or four paddles spaced at 90° from one another. In this particular embodiment the paddles 34 extend continuously along a length of the elongate member 32.

An auger-like configuration of two or more paddles 34 in a continuous spiral flute arrangement would be likely, in practice, to compact solid waste material in the furnace 100 rather than mechanically agitate it, and is therefore undesirable. However, a plurality of paddles 34 configured in discontinuous spiral flutes along the length of the elongate member 32 is anticipated to impart advantageous shearing forces to the solid waste material in the furnace 100 leading to improved mechanical agitation.

The churning device 30 may be continuously rotated in a clockwise or a counterclockwise direction. Alternatively, the churning device 30 may be rotated 180° in a clockwise or a counterclockwise direction and then subsequently rotated 180° in the opposing direction. In some embodiments where a pair of churning and stoking rams 10 is configured in parallel alignment with one another, the churning devices 30 may simultaneously rotate in opposing directions to assist in improved mechanical agitation of the contents of the furnace 100.

The churning device 30 is static with respect to rotation relative to the stoking ram 20 and it will be appreciated that the rotational motion of the churning device 30 described above is effected by rotating the stoking ram 20 in a clockwise or counterclockwise direction by means of a third actuator 60 which is in operative communication with the stoking ram 20 in an arrangement to rotate the stoking ram 20 and the churning device 30 associated therewith.

Figure 8:
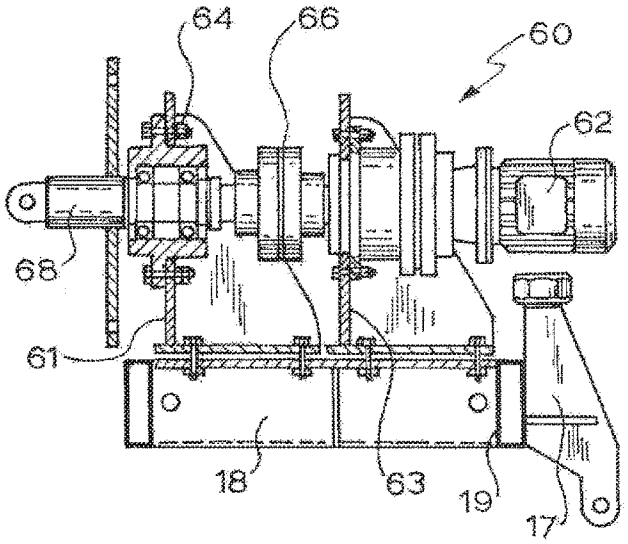
FIG. 8 shows a partial side view of a detail of the portion of the embodiment of FIG. 1 that is shown in the circle A of dotted outline; and, FIG. 9 shows a cross-section view of a pair of churning and stoking rams according to one embodiment of the present disclosure.

The third actuator 60 is shown in detail in FIG. 8, mounted on the elongate plate 18 of the frame 12 my means of a front bracket 61 and a rear bracket 63. The third actuator 60 comprises a motor 62 and a bearing assembly 64 connected via a torsion coupling 66 to a support spindle 68 to impart rotational movement thereto about its central longitudinal axis. The support spindle 68 is coupled to the fixed closed end 24 of the stoking ram 20 and a distal end of the second actuator 50 and, thus, facilitates rotation of the stoking ram 20 and the churning device 30 about their respective central longitudinal axes.

As will be evident from FIGS. 1 to 6, the positioning of the stoking ram 20 between the internal and external positions relative to the furnace 100, and the positioning of the churning device 30 between the extended and retracted positions are entirely independent, leading to the possibility of several different configurations to effect efficient churning of the contents of the furnace.

For example, a sequence of stoking and churning operations to agitate the contents of the furnace 100 may be performed as follows. A "starting" position is shown in FIG. 1, where the stoking ram 20 is positioned in the external position relative to the furnace 100 and the churning device 30 is positioned in the retracted position. The stoking ram 20 can be progressively positioned to a "half-way" position as shown in FIG. 2, and then to the internal position relative to the furnace 100 as shown in FIG. 3. In this way, the contents of the furnace 100 adjacent to the floor of the furnace 100 may be discharged therefrom, and optionally delivered to an adjacent stepped furnace where these contents will now lie "on top" of the contents of the adjacent stepped furnace and present "fresh" surfaces of material for thermal degradation processes to proceed efficiently.

Alternatively, commencing from the "starting position" of FIG. 1, the churning device 30 can be positioned in the extended position such that it extends into a first portion of the furnace 100. The churning device 30 may then be rotated clockwise or counterclockwise to mechanically agitate the contents of the furnace 100, which lie adjacent to the floor of the furnace 100. Still with the churning device 30 in the extended position (and rotating), the stoking ram 20 can be progressively positioned to a "half-way" position as shown in FIG. 5 and then to the internal position relative to the furnace 100 as shown in FIG. 6. In this way, the churning device 30 may traverse the entire length of the floor of the furnace 100, mechanically agitating the contents of the furnace 100 which lie in its path, and providing "fresh" surfaces for thermal degradation processes to proceed efficiently.

It will be appreciated that in arrangements where a pair of churning and stoking rams 10 are aligned in parallel, that the pair of rams 10 may pass through the same sequence of operations as described above, either in phase with one another (i.e., performing the same sequence operation at the same time as one another) or out of phase with one another (i.e., one stoking ram 20 may be progressively extended into the furnace 100 in the extended position while the other stoking ram 20 may be progressively retracted from the furnace 100 into the external position).

The materials of construction of the churning and stoking ram 10 described can be any suitable materials that wear appropriately under high temperatures, and that can be shaped, formed and fitted in the manner so described, and include an appropriate temperature resistant metal such as mild steel, metal alloys, or even ceramics, and so on.

In the description of the disclosure, except where the context requires otherwise due to express language or necessary implication, the words "comprise" or variations such as "comprises" or "comprising" are used in an inclusive sense, i.e., to specify the presence of the stated features, but not to preclude the presence or addition of further features in various embodiments of the disclosure.

It is to be understood that, although prior art use and publications may be referred to herein, such reference does not constitute an admission that any of these form a part of the common general knowledge in the art, in any country.

Numerous variations and modifications will suggest themselves to persons skilled in the relevant art, in addition to those already described, without departing from the basic inventive concepts. All such variations and modifications are to be considered within the scope of the present disclosure, the nature of which is to be determined from the foregoing description.

The invention claimed is:

1. A churning and stoking ram for a furnace comprising:

a frame disposed externally of the furnace;

a stoking ram mounted on the frame in an arrangement to enable the stoking ram to be positionable relative to the furnace between an external position and an internal position and to be rotatable about a central longitudinal axis of the stoking ram;

a first actuator mounted on the frame in operative communication with the stoking ram in an arrangement to position the stoking ram between the external and internal positions;

a churning device associated with the stoking ram and positionable relative to the stoking ram between a retracted position and an extended position;

a second actuator in operative communication with the churning device in an arrangement to position the churning device between the retracted and extended positions; and a third actuator in operative communication with the stoking ram in an arrangement to rotate the stoking ram and the churning device associated therewith.

2. The churning and stoking ram according to claim 1, wherein the churning device and the second actuator are housed in an internal void of the stoking ram.

3. The churning and stoking ram according to claim 2, wherein the second actuator is operative to impart translational movement to the churning device along the central longitudinal axis of the stoking ram between the retracted position wherein the churning device is disposed in the internal void of the stoking ram, and the extended position wherein the churning device is disposed externally of the stoking ram in longitudinal alignment therewith.

4. The churning and stoking ram according to claim 1, wherein the churning device comprises an elongate member having a plurality of paddles outwardly depending therefrom.

5. The churning and stoking ram according to claim 4, wherein the paddles are equiangularly disposed around a central longitudinal axis of the elongate member.

6. The churning and stoking ram according to claim 4, wherein the paddles extend continuously along a length of the elongate member.

7. The churning and stoking ram according to claim 4, wherein the paddles are configured in discontinuous spiral flutes along the length of the elongate member.

8. The churning and stoking ram according to claim 1, wherein the stoking ram is provided with a removable head.

9. The churning and stoking ram according to claim 1, wherein the churning device and/or the stoking ram are generally horizontally disposed proximal a lower surface of the furnace when the churning device is extended and/or the stoking ram is in the internal position relative to the furnace.

10. An apparatus capable of mechanically agitating the contents therein, the apparatus comprising:

a furnace provided with the churning and stoking ram as defined in claim 1.

11. The apparatus according to claim 10, wherein the furnace is provided with a pair of churning and stoking rams in spaced parallel alignment with one another.

12. The apparatus according to claim 11, wherein the pair of churning and stoking rams are arranged to operate independently of one another.

13. The apparatus according to claim 11, wherein the pair of churning and stoking rams are arranged to operate in an inter-related sequence of operations determined by the positions of the stoking ram and the churning device of each respective churning and stoking ram.

14. A system for low temperature gasification of waste solids comprising a plurality of furnaces adapted for low temperature gasification of waste solids, adjacent furnaces being disposed in stepped tiers, each furnace being provided with a churning and stoking ram as defined in claim 1 to mechanically agitate the waste solids therein.

15. The system according to claim 14, wherein each furnace is provided with a pair of churning and stoking rams in spaced parallel alignment with one another.

16. The system according to claim 15, wherein the pair of churning and stoking rams are arranged to operate independently of one another.

17. The system according to claim 15, wherein the pair of churning and stoking rams are arranged to operate in an inter-related sequence of operations determined by the positions of the stoking ram and the churning device of each respective churning and stoking ram.

18. The system according to claim 14, wherein the adjacent furnaces configured in stepped tiers comprise a first stepped furnace and an adjacent second stepped furnace, the adjacent second stepped furnace being configured, in use, to receive solid residue discharged from a discharge port of the first stepped furnace.

19. A method of pyrolysing solid municipal waste with the churning and stoking ram of claim 1, the method comprising:

heating the solid municipal waste in a furnace operating at temperatures in an range of 500° C. to 1100° C.;

inserting the churning device into the furnace; and rotating the churning device about the longitudinal axis to mechanically agitate the solid municipal waste to expose and thermally degrade partially pyrolysed solid municipal waste.

20. The method according to claim 19, further comprising discharging the partially pyrolysed solid municipal waste into an adjacent furnace for further pyrolysis.

* * * * *